US009567838B2

(12) United States Patent
Marshall et al.

(10) Patent No.: US 9,567,838 B2
(45) Date of Patent: Feb. 14, 2017

(54) LONG-STROKE HYDRAULIC LIFT SYSTEM HAVING REDUCED HEIGHT

(71) Applicant: Halliburton Energy Services, Inc., Houston, TX (US)

(72) Inventors: Joe Robert Marshall, Katy, TX (US); Justin Wayne Hayes, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/782,380

(22) PCT Filed: Jul. 1, 2013

(86) PCT No.: PCT/US2013/048944

§ 371 (c)(1),
(2) Date: Oct. 5, 2015

(87) PCT Pub. No.: WO2015/002634

PCT Pub. Date: Jan. 8, 2015

(65) Prior Publication Data

US 2016/0102534 A1 Apr. 14, 2016

(51) Int. Cl.
*E21B 43/12* (2006.01)

(52) U.S. Cl.
CPC ..... *E21B 43/126* (2013.01)

(58) Field of Classification Search
CPC ..... E21B 43/126; F04B 47/00; F04B 47/02; F04B 47/04
USPC ..... 166/377
See application file for complete search history.

(56) References Cited

U.S. PATENT DOCUMENTS 2,838,910 A * 6/1958 Bacchi ..... F04B 47/04 91/216 B
2,982,100 A * 5/1961 Sinclair ..... F04B 47/04 60/372
4,305,461 A * 12/1981 Meyer ..... E21B 33/03 166/77.4
4,480,685 A * 11/1984 Gilbertson ..... F04B 47/04 166/68.5
4,490,097 A * 12/1984 Gilbertson ..... F04B 47/04 166/68.5
4,646,517 A * 3/1987 Wright ..... F04B 47/04 60/369
4,890,671 A * 1/1990 Baxter ..... E21B 19/06 166/250.01

(Continued)

OTHER PUBLICATIONS

International Search Report and Written Opinion, Mar. 31, 2014, 10 pages; Korean International Searching Authority.

*Primary Examiner* — Matthew R Buck
(74) *Attorney, Agent, or Firm* — Haynes and Boone, LLP

(57) ABSTRACT

A lift and method for reciprocating a downhole pump includes an linear actuator, such as a piston-cylinder arrangement, located coaxially above the stuffing box of a well. The linear actuator includes a connecting rod that passes through and seals against the stuffing box, thereby taking the place of the traditional polished rod and allowing the linear actuator to be positioned lower and closer to the well. The connecting rod may be connected to the traditional polished rod below the stuffing box. A stopper may be selectively removed to allow the connecting rod to be pulled clear of the stuffing box while using the polished rod to seal the well, thereby allowing the linear actuator to be removed for maintenance.

16 Claims, 4 Drawing Sheets

(56) References Cited

U.S. PATENT DOCUMENTS

| | | | | |
|---|---|---|---|---|
| 5,236,038 | A | 8/1993 | Clemishire | |
| 2006/0260800 | A1* | 11/2006 | Bertane | F04B 47/02 166/88.1 |
| 2008/0135259 | A1* | 6/2008 | Brown | E21B 43/127 166/369 |
| 2009/0194291 | A1* | 8/2009 | Fesi | E21B 43/126 166/369 |
| 2009/0205827 | A1 | 8/2009 | Swietlik et al. | |

* cited by examiner

LONG-STROKE HYDRAULIC LIFT SYSTEM HAVING REDUCED HEIGHT

CROSS REFERENCE TO RELATED APPLICATIONS

The present application is a U.S. National Stage patent application of International Patent Application No. PCT/US2013/048944, filed on 1 Jul. 2013, the benefit of which is claimed and the disclosure of which is incorporated herein by reference in its entirety.

TECHNICAL FIELD

The present disclosure relates generally to oilfield equipment, and in particular to wellhead-mounted reciprocating sucker rod pumping units, commonly referred to as pump jacks.

BACKGROUND

Hydrocarbons are often produced from well bores by reciprocating downhole pumps that are driven from the surface by pumping units. A pumping unit is connected to its downhole pump by a rod string, which is assembled from a number of sucker rods. Often, the downhole pump is referred to as a sucker rod pump and the surface pumping unit that reciprocates the rod string is referred to as a pump jack, although other terms may also be used by routineers in the art. Several types of pumping units are known in the art, including the prolific walking beam style pumps, and pumps that employ a piston-cylinder arrangement.

The uppermost rod in the rod string is called a polished rod, so named because of its smooth finish. The pump jack carries the polished rod, typically via a wire rope bridal and carrier bar. The polished rod extends through a packing gland or stuffing box at the wellhead for providing a dynamic well seal as the polished rod strokes up and down. A rod string of sucker rods hangs from the polished rod within a tubing string located within the well casing. The rod string is connected to the plunger of the subsurface pump. In a reciprocating cycle of the pump jack, formation fluids flow into the well and pump housing during the downstroke, and well fluids are lifted within the tubing string during the rod string upstroke.

One type of pump jack is a wellhead-mounted linear lift system. The linear lift system has an elongate frame vertically oriented and mounted atop the wellhead. The frame may be supported with guy wires. The top of the frame carries a ram assembly oriented to be in line with the wellhead. The ram assembly may be hydraulic or pneumatic, for example. A piston rod extends downwardly from the ram assembly and connects to the polished rod of the sucker rod pump above the wellhead. Application of a pressurized fluid to the ram assembly lifts the piston rod, the polished rod, the rod string, and the plunger of the downhole pump to lift well fluids within the tubing string. A subsequent release of pressure to the ram assembly allows the piston rod, the polished rod, the rod string, and the plunger of the downhole pump to descend, thereby completing one pump cycle.

Such linear lift systems are typically characterized by a small footprint, low weight, high load capacity, an easily adjustable ultra-long stroke, and a simple, low-maintenance actuator that uses a single-acting ram. Because of these advantages, there are circumstances in which it is desirable to use a wellhead-mounted linear lift system.

BRIEF DESCRIPTION OF THE DRAWINGS

Embodiments are described in detail hereinafter with reference to the accompanying figures, in which.

DETAILED DESCRIPTION

Figure 1:
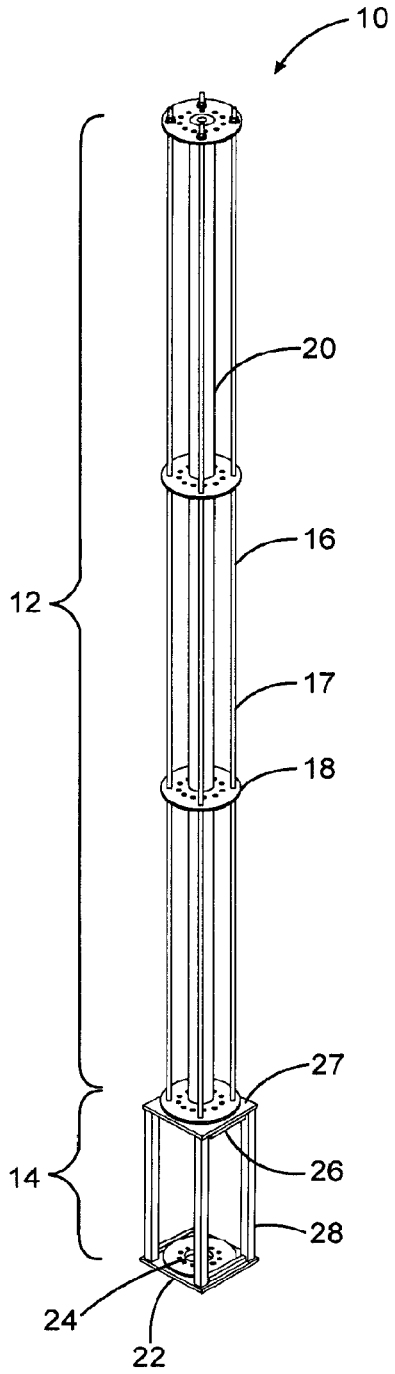
FIG. 1 is a perspective view of an improved linear lift system according to a present embodiment showing a lower wellhead mount and an upper linear actuator, which may be a piston-cylinder assembly as shown.

FIG. 1 illustrates a linear lift system 10 according to a present embodiment that provides a reduced overall height for the same stroke capability as compared to a conventional wellhead linear lift system of prior art, thereby minimizing weight and maximizing transportability.

Lift 10 includes a linear actuator assembly 12 carried atop a wellhead mount 14. If necessary, linear actuator assembly 12 may include a frame assembly 16, guy wires (not illustrated), or the like, for laterally support. In the embodiment shown, the linear actuator assembly frame 16 includes a series of tie rods 17 and support plates 18, although other suitable arrangements may be used as appropriate.

In one embodiment, linear actuator assembly 12 includes a piston-cylinder assembly 20, which may be hydraulic or pneumatic for example. Other linear actuators, such as mechanical or electromagnetic, may be used as appropriate.

Wellhead mount 14 can take any number of forms provided it can carry linear actuator assembly 12 at an appropriate distance above a wellhead and allow access to the wellhead for operation and maintenance. For example, as illustrated, wellhead mount 14 includes a baseplate 22 for mounting to the ground with a wellhead opening 24 formed therethrough. Linear actuator assembly 12 is mounted to a pedestal 27, which is carried above baseplate 22 by a table 26 and legs 28.

Figure 2:
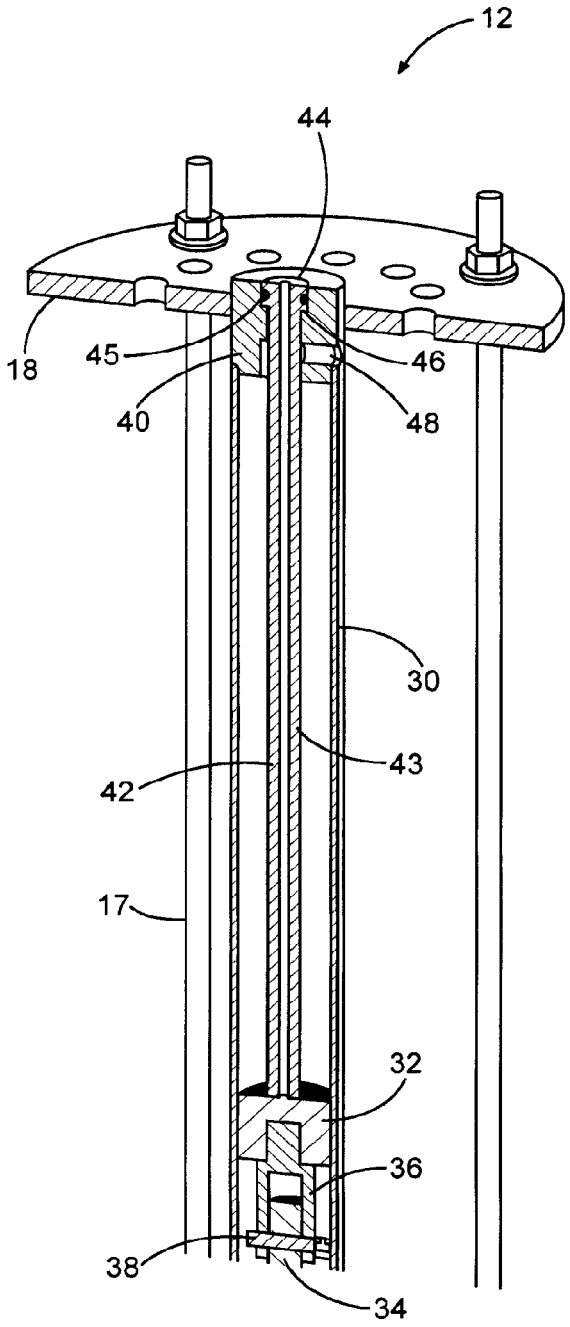
FIG. 2 is an enlarged perspective longitudinal cross section of the upper end of the piston-cylinder assembly of FIG. 1, showing a stopper mounted in the top end of the cylinder for limiting upward piston travel.

FIG. 2 shows the top end of the piston-cylinder assembly 20 as it is configured for pumping operation. Referring to FIG. 2, piston-cylinder assembly 20 includes a cylinder 30, a piston 32 that fits closely and slides within cylinder 30, and a connecting rod 34 for transmitting the movement of piston 32. Connecting rod 34 is connected to piston 32 via a yoke fitting 36 and pin or bolt 38 to allow for some minor misalignment between connecting rod 34 and piston 32.

The top of cylinder 30 is terminated by an upper plug 40, which may be threaded into cylinder 30. Upper plug 40 includes a port 48 through which actuation fluids may enter and exit the upper portion of cylinder 30. In a preferred embodiment, upper plug 40 has a central bore formed therethrough, into which an elongate, rod-shaped stopper 42 is received. The top end of stopper 42 has an enlarged knob 44 with a circumferential sealing element 45, such as an o-ring. The bore within upper plug 40 has a profile that defines a seat 46 into which knob 44 is received so as to suspend stopper 42 from upper plug 40 and that forms a seal against sealing element 45. Stopper 42 is removably secured in place within upper plug 40 by one or more conventional fastening techniques, such as by threading, retaining ring, pins, etc. (not illustrated).

As illustrated in FIG. 2, stopper 42 limits the upward travel of piston 32. During installation and maintenance, stopper 42 can be removed so that piston 32 can travel to s higher elevation, as described in greater detail below with respect to FIGS. 5 and 6. Stopper 42 may include a conduit 43, which can be used for locating a proximity sensor, switch, pressure sensor, or the like and the bottom of the stopper and routing the corresponding electrical conduits out through the top of the cylinder. Packing, stuffing, or a similar gland seal (not illustrated) is disposed within conduit 43 to provide a pressure-tight seal, as is known in the art.

Figure 3:
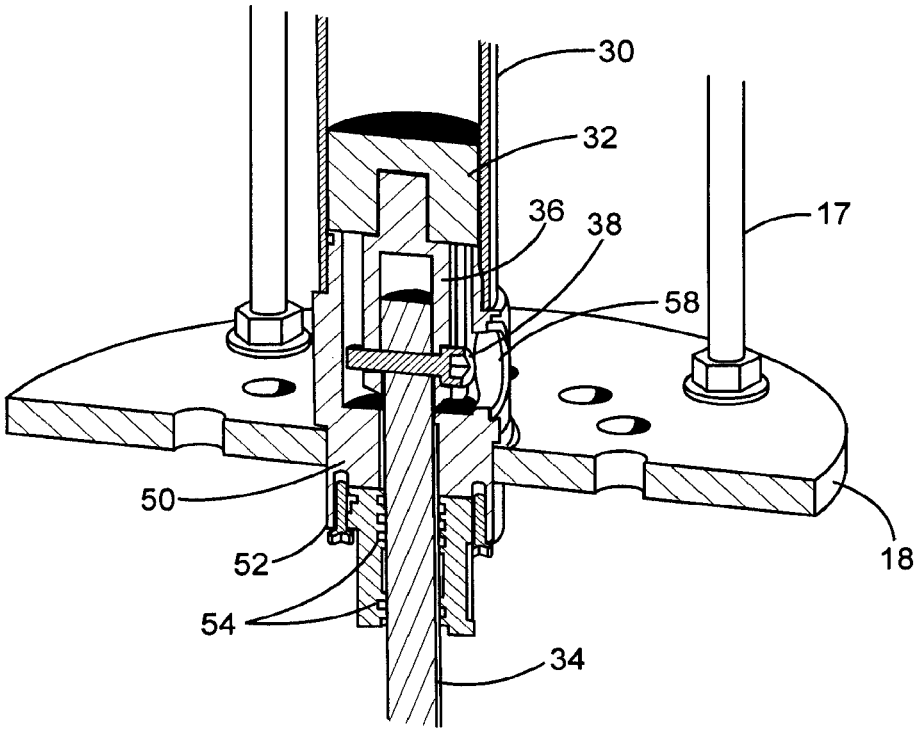
FIG. 3 is an enlarged perspective longitudinal cross section of the lower end of the piston-cylinder assembly of FIG. 1, showing details of the piston, connecting rod, gland, and seals.

FIG. 3 shows the bottom end of the piston-cylinder assembly 20, with piston 32 located at the bottom of its stroke. The bottom of cylinder 30 is terminated by a lower plug 50, which may be threaded into cylinder 30. Lower plug 50 includes a port 58 through which actuation fluids may enter and exit the lower portion of cylinder 30. Lower plug assembly 50 has a central bore through which connecting rod 34 passes. A gland 52 mounts to the bottom of lower plug 50. Gland 52 includes various wipers and seals 54 that engage and provide a dynamic seal against the outer surface of connecting rod 34.

Figure 4:
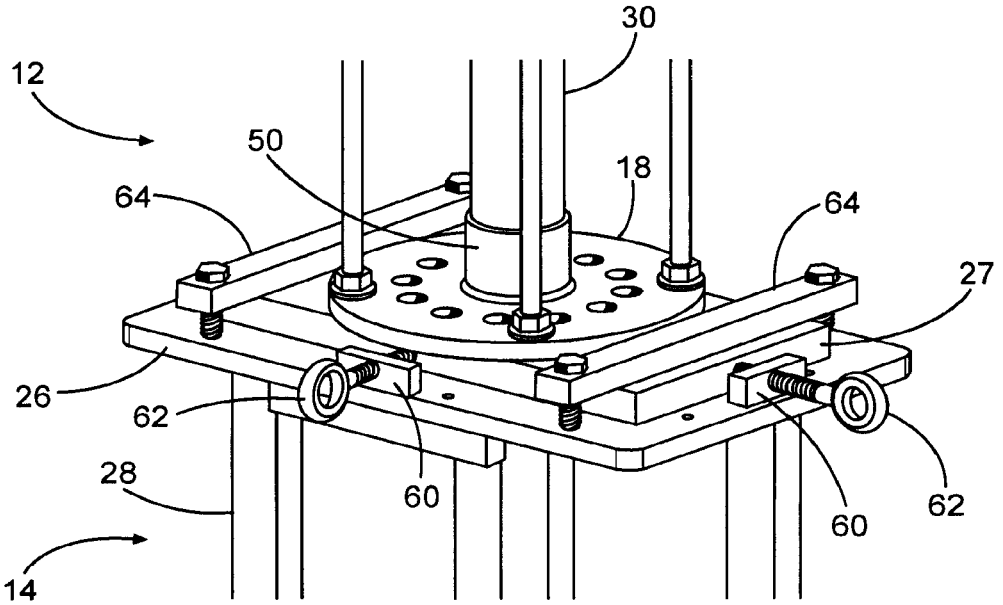
FIG. 4 is a perspective view of the lower end of the piston-cylinder assembly and upper end of the wellhead mount of FIG. 1, showing a position adjustment mechanism for precisely aligning the cylinder with a wellhead.

Referring to FIG. 4, the lateral position of linear actuator assembly 12 is ideally adjustable with respect to wellhead mount 14 so that linear actuator assembly 12 can more easily be brought into coaxial alignment with a wellhead above which it is mounted. In one embodiment, linear actuator assembly 12 is mounted to pedestal 27, which is slideably carried atop table 26. Table 26 includes raised blocks or nut plates 60 having threaded holes formed therethrough. Bolts 62 are threaded through nut plates 60 and engage pedestal 27. Tightening or loosening of bolts 62 translates pedestal 27 in lateral and transverse directions. Once pedestal 27 is properly aligned, it its position is fixed with respect to table 26 by clamping bars 64.

Figure 5:
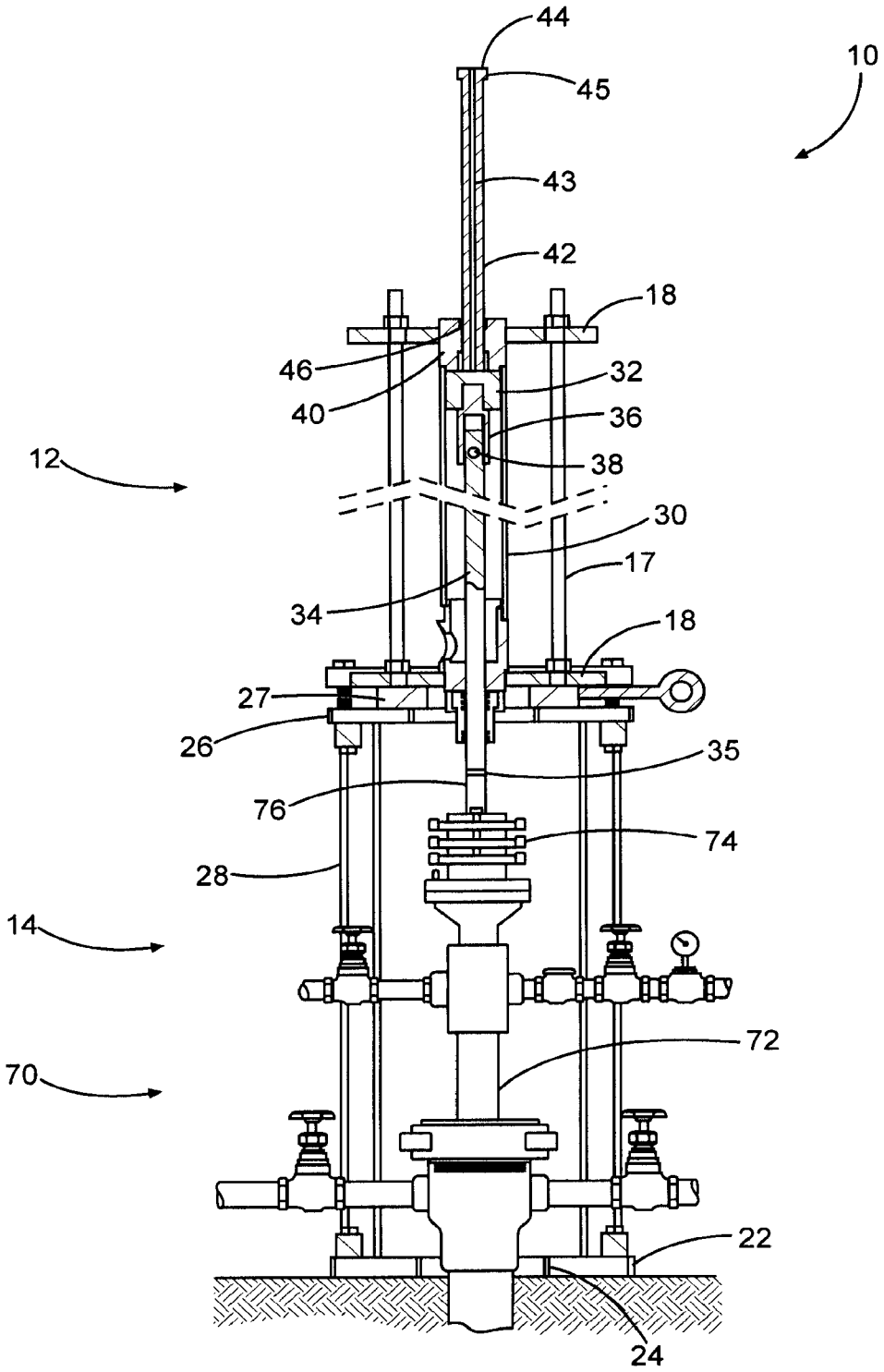
FIG. 5 is an elevation in partial cross section of the linear lift system of FIG. 1 mounted at a wellhead and connected to the polished rod of the sucker rod pump during initial installation or maintenance of the lift, for example.
Figure 6:
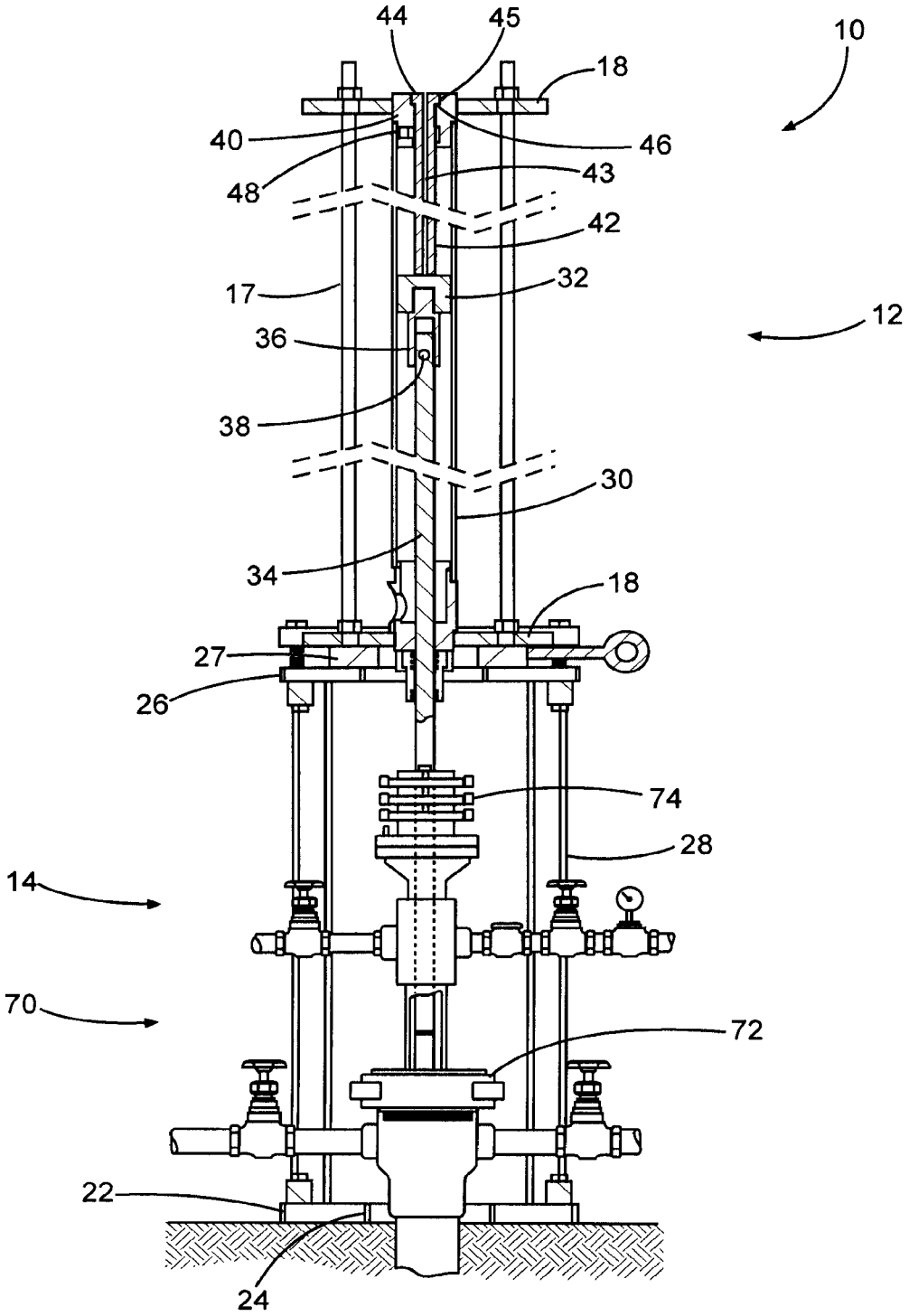
FIG. 6 is an elevation in partial cross section of the linear lift system of FIG. 5, showing the lift during normal pumping operation with the piston located at the top of its operational stroke.

FIGS. 5 and 6 illustrate the operation and novel features of linear lift system 10. Referring to FIG. 5, linear lift system 10 is initially positioned over a conventional wellhead 70, which may include a Christmas tree 72 and a stuffing box 74. Stopper 42 is removed from cylinder 30, and piston 32 is positioned at its upmost position, abutting upper plug 40. In this position, the bottom end 35 of connecting rod 34 is located above stuffing box 74. The bottom end 35 of connecting rod 34 is connected to the conventional polished rod 76 of the sucker rod pump.

Unlike a typical pump jack, which uses a carrier bar or other connector to connect to the polished rod that is larger than the outer diameter of the polished rod, according to a preferred embodiment, connecting rod 34 has the same outer diameter as polished rod 76, and it connects to polished rod 76 using a connection that is the same size or smaller than the polished rod outer diameter. Because of this feature, as shown in FIG. 6, polished rod 76 can be lowered by connecting rod through stuffing box 74 so as to completely clear the stuffing box packing, and connecting rod 34, which also has a polished surface, is used to create the well seal with stuffing box 74.

FIG. 6 shows linear lift system 10 configured for normal pumping operation, with the sucker rod pump at the top of its stroke. Stopper 42 is installed in upper plug 40 as described above with respect to FIG. 2. The longitudinal length of stopper 42 is selected so that when piston 32 abuts the bottom end of stopper 42, the sucker rod plunger is at the top of its allowed travel. At this position, connecting rod 34 takes on the traditional sealing function of polished rod 76, and polished rod 76, located entirely below stuffing box 74, functions as an ordinary sucker rod. Accordingly, in order to accommodate linear lift system 10, a length of sucker rod must be removed from the rod string.

By using a connecting rod 34 that doubles as a polished rod, a distance essentially just shy of an entire stroke length can be eliminated from the overall height of the linear lift system 10 as compared to a linear lift system of prior art. That is, with a prior art lift system, at the bottom of the stroke the connecting rod is located just above the stuffing box, but with linear lift system 10, at the top of the stroke the connecting rod is located just below the stuffing box.

By connecting connecting rod 34 to polished rod 76 rather than to a sucker rod (and removing the polished rod 76), one can remove linear lift system 10 from the well without having the disassemble or remove stuffing box 74, thereby maintaining positive control over the well.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A method of reciprocating a pump disposed within a well, said pump connected to a rod string, said rod string including a plurality of sucker rods and terminating at an upper end with a polished rod, said well terminating at the surface of the earth with a stuffing box that is arranged for providing a dynamic seal about said polished rod, the method comprising:

disposing an actuator above and substantially coaxial with said well, said actuator having a cylinder, a piston slideably disposed in said cylinder, a connecting rod connected to said piston, and a gland connected to a lower end of said cylinder and providing a dynamic seal about said connecting rod;

connecting said connecting rod to an upper end of said polished rod at an elevation above said stuffing box;

lowering said polished rod through said stuffing box; and then lowering said connecting rod into said stuffing box; and positioning said connecting rod through said stuffing box, said connecting rod being characterized by an outer diameter and finish substantially similar to said polished rod so that said stuffing box is operable to provide a dynamic seal about said connecting rod.

2. The method of claim 1 further comprising:
after the lowering said connecting rod into said stuffing box, limiting an upward travel of said piston so as to prevent said connecting rod from being raised clear of said stuffing box.

3. The method of claim 2 further comprising:
providing a removable stopper within an upper portion of said cylinder;
providing a conduit within said stopper; and
providing a sensor in said conduit.

4. The method of claim 1 further comprising:
removing one of the plurality of sucker rods from said rod string for accommodating said polished rod below said stuffing box.

5. The method of claim 1 further comprising:
providing a mount above said well;
carrying said actuator atop said mount;
providing an adjustment mechanism for laterally positioning said actuator with respect to said mount; and
adjusting a lateral position of said actuator using said adjustment mechanism so as to coaxially align said connecting rod with said stuffing box.

6. The method of claim 1 wherein:
said connecting rod is a unitary structure that simultaneously engages said gland and stuffing box.

7. The method of claim 1 further comprising:
providing a pressurized fluid to a lower portion of said cylinder to lift said piston, said connecting rod and said rod string; and
removing said pressurized fluid to lower said piston, said connecting rod, and said rod string.

8. A lift for reciprocating a downhole pump located within a well, comprising:
a cylinder positioned over a stuffing box of said well;
a gland coupled to said cylinder;
a piston slideably received in said cylinder;
a stopper removably disposed in said cylinder for limiting an upward travel of said piston; and
a unitary connecting rod connected to said piston and passing through said gland, said gland operative to form a seal between said connecting rod and said cylinder, said connecting rod further passing through said stuffing box, said stuffing box operative to form a seal between said connecting rod and said well;
wherein said connecting rod is connected to said downhole pump via a rod string in said well;
wherein said connecting rod is connected to a polished rod below said stuffing box;
wherein said connecting rod and said polished rod are prevented from being raised clear of said stuffing box when said stopper is disposed in said cylinder;
whereby reciprocating said piston in said cylinder operates to reciprocate said pump.

9. The lift of claim 8 further comprising:
a conduit formed in said stopper; and
a sensor housed in said conduit.

10. The lift of claim 8 further comprising:
a mount positioned above said well, said cylinder carried atop said mount.

11. The lift of claim 10 further comprising:
an adjustment mechanism operable for laterally positioning said cylinder with respect to said mount; whereby said cylinder is positionable so that said connecting rod is coaxially aligned with said stuffing box.

12. A lift for reciprocating a downhole pump located within a well, comprising:
a cylinder positioned over a stuffing box of said well;
a gland coupled to said cylinder;
a piston slideably received in said cylinder;
a stopper removably disposed in said cylinder for limiting an upward travel of said piston;
a unitary connecting rod connected to said piston and passing through said gland, said gland operative to form a seal between said connecting rod and said cylinder, said connecting rod further passing through said stuffing box, said stuffing box operative to form a seal between said connecting rod and said well;
a conduit formed in said stopper; and
a sensor housed in said conduit.

13. The lift of claim 12 wherein:
said connecting rod is connected to said downhole pump via a rod string in said well;
whereby reciprocating said piston in said cylinder operates to reciprocate said pump.

14. The lift of claim 13 wherein:
said connecting rod is connected to a polished rod below said stuffing box.

15. The lift of claim 12 further comprising:
a mount positioned above said well, said cylinder carried atop said mount.

16. The lift of claim 15 further comprising:
an adjustment mechanism operable for laterally positioning said cylinder with respect to said mount;
whereby said cylinder is positionable so that said connecting rod is coaxially aligned with said stuffing box.

* * * * *